United States Patent [19]

Bridges

[11] Patent Number: 4,465,133

[45] Date of Patent: Aug. 14, 1984

[54] CASING HANGER COLLET

[75] Inventor: Charles D. Bridges, Houston, Tex.

[73] Assignee: Combustion Engineering, Inc., Windsor, Conn.

[21] Appl. No.: 418,503

[22] Filed: Sep. 15, 1982

[51] Int. Cl.[3] ..... F21B 43/10

[52] U.S. Cl. ..... 166/208; 166/214

[58] Field of Search ..... 166/208, 214; 285/141, 285/140, 143, 44, 55, 322

[56] References Cited

U.S. PATENT DOCUMENTS

| | | | |
|---|---|---|---|
| 3,265,409 | 8/1966 | Crain et al. | 285/27 |
| 3,420,308 | 1/1969 | Putch | 166/208 |
| 3,893,717 | 7/1975 | Nelson | 285/3 |
| 4,116,277 | 9/1978 | McGee et al. | 166/315 |
| 4,139,059 | 2/1979 | Carmichael | 166/208 |
| 4,167,970 | 9/1979 | Cowan | 285/141 X |
| 4,307,902 | 12/1981 | Schnatzmeyer | 166/214 X |

OTHER PUBLICATIONS

Gray Tool Company, Drawing Stock Nos. 131271,112020.

*Primary Examiner*—Ernest R. Purser
*Assistant Examiner*—Thuy M. Bui
*Attorney, Agent, or Firm*—Edward L. Kochey, Jr.

[57] ABSTRACT

A hanger collet (10) for a mudline casing suspension system in the form of a hollow cylinder. Vertical slots (32,34) create a serpentine form which is radially collapsible. Flow space behind the legs (30) permits a flow-path for running and cementing.

8 Claims, 4 Drawing Figures

CASING HANGER COLLET

BACKGROUND OF THE INVENTION

The invention relates to casing hangers and in particular to a support collect for mudline-type hangers.

Mudline suspension systems are used to provide a means to hang off well bore casing strings below the ocean mudline during drilling. This avoids a need to build an offshore structure to accept the string weights and permits one to abandon the well temporarily until area exploration or all drilling of that location is completed.

As drilling in offshore applications tends toward deeper production zones, the casing hangers must carry additional weight. Deeper holes require more and longer strings to complete the well. Increasing wall sections to deal with the higher pressure compound suspension problems with heavier string weights and reduced annular area to work in. The annular area must be effectively divided between suspension and circulation (for cementing purposes) requirements.

Prior art hangers have used locking rings. These rings are secured to the inner casing and are continuously urged outwardly. They collapse sufficiently to pass through the casing bore and include latches on the rings which are formed to match receiving grooves in the outer casing at the support elevation. Releasable retaining means such as shear pins are sheared by the weight of the casing when the latches lock into the grooves. The inner casing is then lowered so that its shoulder rests on the ring.

One form of prior art ring illustrated in U.S. Pat. No. 3,893,717 is a C-shape with a section necessarily removed to allow it to collapse circumferentially to a point that it will pass thru the bore of the casing used above the hanger housing in the preceeding string. The C-shape ring requires a substantial wall section to provide a load carrying area for the "ring to housing" interface (seat) and also a load carrying area for the ring to hanger support, (top of the C-shape ring). Being that the hanger body must be able to drift thru the casing, these load carrying areas must be in two distinct radial planes.

To increase flexibility of the C-shape ring and avoid permanent deformation, additional parts of the wall section at selected points around the circumference must be removed. This removes bearing surface, in addition to that removed to permit collapse.

Another form also shown in U.S. Pat. No. 3,893,717 uses separate dogs urged outwardly by an internal C-member.

Still another form shown in U.S. Pat. No. 4,139,059 uses fingers which are cantilevered upwardly from a lower ring.

SUMMARY OF THE INVENTION

A hanger collet for a mudline suspension system is of a single piece in the form of a hollow cylinder. Vertical legs of the cylinder are formed by a plurality of part-length vertical slots alternating from the top and bottom and overlapping. Upper and lower return segments join adjacent legs. Latch means are located on the upper segments, extending outwardly for engagement with the outer casing.

The vertical legs have flow space behind them so that flow passing into the bottom opening slots may pass to and through the upper slots during cementing, thereby passing by the hanger. A minimum amount of the load bearing portion must be removed, since all of the slots cooperate to allow the reduced diameter. All the slots are the equivalent of the removed section of a C-ring, and additional material removal is not required. The segments move radially in and out without any circumferential motion. The collet may be designed for low stress during collapse, precluding the need for high tensile steel.

DESCRIPTION OF THE PREFERRED EMBODIMENT

Figure 1:
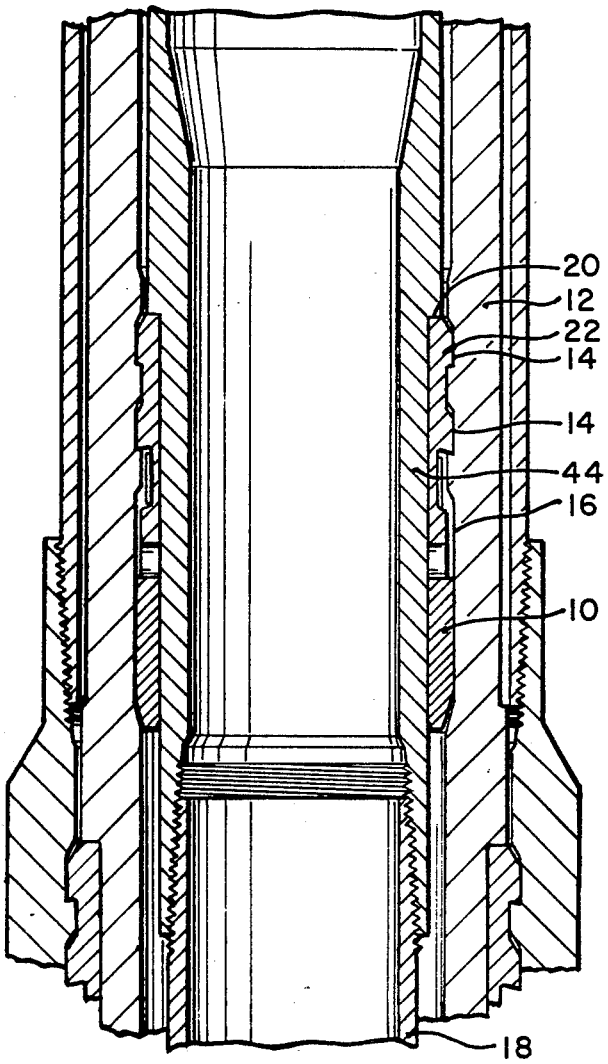
FIG. 1 is a sectional view assembly drawing showing the collet in use.
Figure 4:
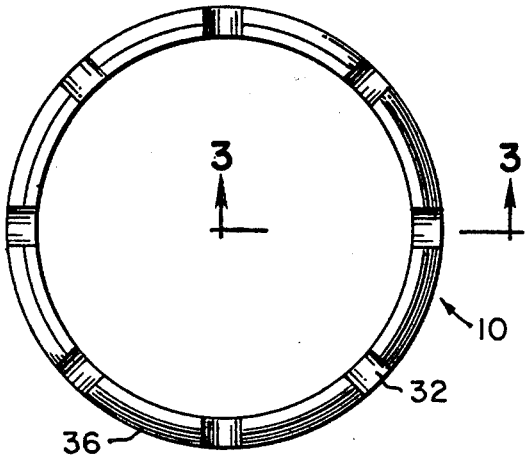
FIG. 4 is a plan view of the collet.
Figure 2:
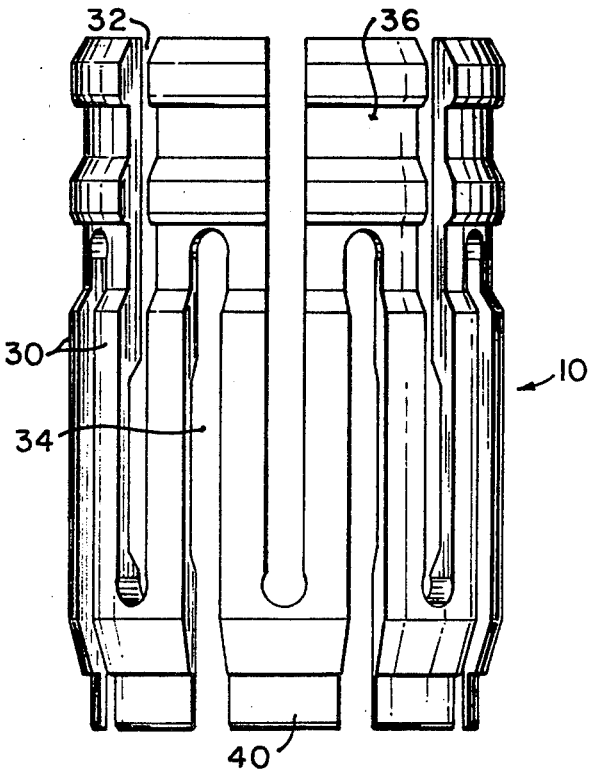
FIG. 2 is a side elevation of the collet.
Figure 3:
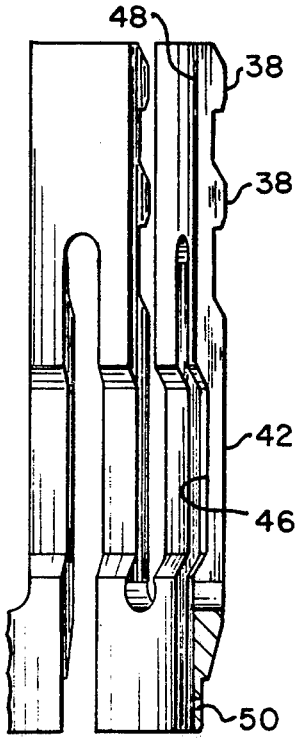
FIG. 3 is a section of the collet through an upper slot showing the structure of an individual leg.

The hanger collet 10 is illustrated in FIG. 1 in place carrying an inner casing from an outer casing. The outer casing includes a hanger body 12 which has annular grooves 14 and 16.

The collet is urged outwardly so that when it reaches the location where it may mate with the annular grooves, it springs outwardly into the position shown. The load from the inner casing 18 with its hanger body 44 passes through the upper support shoulder 20 of the collet and then through the latching means 22 to the outer casing 12.

FIG. 1 illustrates the hanger collet 10 as a hollow cylinder of low alloy steel. The collet is about 8 and ½inch ID and 15 inches high. Vertical legs 30 are formed between part-length slots 32 from the top and 34 from the bottom.

Upper return segments 36 join adjacent legs and carry latch means 22 extending outwardly therefrom. Lower return segments 40 join adjacent legs so that a sinuous pattern is formed of the legs.

The collet must be collapsed when running the hanger so that the collet fits within the inside diameter of the outer casing 12. As the collet is squeezed down, the open ends of the slots close with bending occurring in the legs 30 and in the return segments 36 and 40. The legs tend to take an S-shape while the return bends at the segments exert a force tending to open the slots. This creates a force returning the collet to its full uncollapsed size. The length, size and number of the legs may be varied to achieve the desired stiffness of the collet.

The collet is strain limited during collapse, rather than load limited. Accordingly, the collet may be made as soft as desired with an increased number of slots, decreased thickness of legs, and/or increased length. Maximum stress is expected at the crotch of the segments in a very localized manner. Because of the substantial remaining portion of each segment, even permanent deformation of the high stress area would not prevent full expansion of the released collet. The lack of need for high tensile strength steel, permits the use of lower alloy steels less susceptible to stress propagated failures.

The outboard surface 42 of the legs 30 extends outwardly the same distance as the latching means 22. Accordingly, this surface along with the latching means forms a key, whereby the collet can expand during the running operation only when both latches and the legs key with matching grooves in the outer casing. Since the compressed collet takes a barrel shape, rubbing during running takes place primarily on the legs.

In its latched position the collet 10 as shown in FIG. 1 will usually be locked in place with a back up member such as casing hanger body 44. Legs 30 are formed with an inner surface 46 being of a larger diameter than the inner surface 48 of the segments 36. This provides a flowpath during the cementing operation upwards through slot 34, behind the legs 30 to slot 32, and then upwardly between segments 36. Each lower segment 40 has a hole 50 for receiving a shear pin. This provides a means for releasably attaching the collet to the inner casing for pulling the collet downwardly before it latches into place.

The collet is easily manufactured to precise tolerances by first machining the inner and outer surfaces and then milling the slots.

Both top and bottom segments move radially in and out resulting in freedom from any circumferential component of motion during collapse and expansion. This permits a cleaner shear or latch action on any holddown linkage. This also avoids a rolling under action which can occur at the edge of a C-shaped member when it is collapsed. If one segment is blocked from latching, it will not restrain latching of adjacent segments and will increase the force tending to latch the other segments.

I claim:

1. A hanger collet for suspending an inner casing within and from an outer casing comprising: a hollow fully cylindrical body; vertical legs of said cylindrical body formed by a plurality of part-length vertical slots alternately from the top and bottom, the slots overlapping to form the legs; upper and lower return segments thereby formed joining adjacent legs; latch means located on said upper segments and extending outwardly therefrom, the inner surface of at least a portion of said legs being outboard of the inner surface of said segments, whereby a fluid flowpath may be established between adjacent slots behind the legs.

2. A hanger collet for suspending an inner casing within and from an outer casing comprising: a hollow fully cylindrical body; vertical legs of said cylindrical body formed by a plurality of part-length vertical slots alternately from the top and bottom, the slots overlapping to form the legs; upper and lower return segments thereby formed joining adjacent legs; latch means located on said upper segments and extending outwardly therefrom; said legs being thicker in the radial direction at the bottom and top ends thereof than at a substantial length of the central portion of said legs whereby strain more readily takes place in the legs, reducing stress in the segment.

3. A collet as in claim 2: said legs and latch means each having an outboard surface and wherein said legs extend outwardly such that the outboard surface of the legs extend the same distance as the outboard surface of said latch means.

4. A mudline casing hanger assembly for supporting a string of casing within an outer hanger body comprising:

said outer hanger body having at least one annular groove around the inner periphery thereof;

an inner hanger body having a downwardly facing shoulder around the outer periphery thereof;

a hanger collet surrounding said inner hanger body, said collet being a hollow fully cylindrical body, vertical legs of said collet formed by a plurality of part-length vertical slots alternately from the top and bottom, the slots overlapping to form the legs, upper and lower return segments thereby formed joining adjacent legs, outwardly extending latch means located on said upper segments;

said collet having an upwardly facing shoulder adapted to mate with said downwardly facing shoulder for supporting said inner hanger body, and having said latch means shaped to mate with said annular grooves for supporting the collet from said outer hanger body.

5. A mudline casing hanger assembly as in claim 4: said legs and segments each having an inner surface wherein the inner surface of at least a portion of said legs is outboard of inner surface of said segments, whereby a fluid flowpath may be established between adjacent slots behind the legs.

6. A mudline casing hanger assembly as in claim 4: said leg and latch means each having an outboard surface wherein said legs extend outwardly such that the outboard surface of the legs extend the same distance as the outboard surface of said latch means with the collet in its uncomprised condition.

7. A collet as in claim 6: said legs being thicker in the radial direction at the bottom end thereof than at a substantial length of the central portion of said legs whereby strain more readily takes place in the legs, reducing stress in the segments.

8. A collet as in claim 4: said legs being thicker in the radial direction at the bottom end thereof than at a substantial length of the central portion of said legs whereby strain more readily takes place in the legs, reducing stress in the segments.

* * * * *